US007615927B2

(12) United States Patent
Mizuta

(10) Patent No.: US 7,615,927 B2
(45) Date of Patent: Nov. 10, 2009

(54) LOW ADDRESS DISCHARGE VOLTAGE PLASMA DISPLAY PANEL

(75) Inventor: Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 573 days.

(21) Appl. No.: 11/116,992

(22) Filed: Apr. 27, 2005

(65) Prior Publication Data

US 2005/0242730 A1 Nov. 3, 2005

(30) Foreign Application Priority Data

Apr. 29, 2004 (KR) ..... 10-2004-0029978

(51) Int. Cl.
*H01J 17/49* (2006.01)

(52) U.S. Cl. ..... 313/587; 313/581; 313/584; 313/586; 315/169.4; 345/71

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 3,538,371 | A * | 11/1970 | Defevere et. al. | 313/517 |
| 4,853,590 | A * | 8/1989 | Andreadakis | 313/485 |
| 6,541,922 | B2 | 4/2003 | Shirozu | |
| 6,703,772 | B2 * | 3/2004 | Hasegawa et al. | 313/384 |
| 6,777,873 | B2 * | 8/2004 | Hashikawa | 313/582 |
| 6,992,444 | B2 * | 1/2006 | Hashikawa et al. | 313/587 |
| 7,038,382 | B2 * | 5/2006 | Hashikawa et al. | 313/582 |
| 7,045,962 | B1 * | 5/2006 | Murai et al. | 313/582 |
| 7,173,374 | B2 * | 2/2007 | Yoo | 313/583 |
| 7,205,963 | B2 * | 4/2007 | Amatsuchi | 345/67 |
| 2003/0168977 | A1 * | 9/2003 | Hashikawa | 313/582 |
| 2004/0189199 | A1 * | 9/2004 | Komaki et al. | 313/582 |
| 2004/0227464 | A1 * | 11/2004 | Hashikawa et al. | 313/584 |
| 2005/0062422 | A1 * | 3/2005 | Sasaki et al. | 313/587 |

FOREIGN PATENT DOCUMENTS

CN 1303116 A 7/2001

(Continued)

OTHER PUBLICATIONS

Patent Abstracts of Japan for Publication No. 2000-357462; Date of publication of application Dec. 26, 2000, in the name of Hiroshi Mori et al.

(Continued)

*Primary Examiner*—Sikha Roy
*Assistant Examiner*—Jose M Diaz
(74) *Attorney, Agent, or Firm*—Christie, Parker & Hale, LLP

(57) ABSTRACT

A plasma display panel includes a first substrate and a second substrate provided opposing one another with a predetermined gap therebetween. A plurality of barrier ribs are mounted in the gap between the first and second substrates to define a plurality of discharge cells. A plurality of phosphor layers are respectively formed in the discharge cells. A plurality of display electrodes are formed on the first substrate along a first direction, and a plurality of address electrodes are formed on the first substrate along a second direction which intersects the first direction and separated from the display electrodes.

28 Claims, 11 Drawing Sheets

FOREIGN PATENT DOCUMENTS

| | | | |
|---|---|---|---|
| CN | 1442874 | A | 9/2003 |
| JP | 07-226164 | | 8/1995 |
| JP | 08-022772 | | 1/1996 |
| JP | 09-035641 | | 2/1997 |
| JP | 09-265913 | | 10/1997 |
| JP | 2000-357462 | | 12/2000 |
| JP | 2001-189132 | | 7/2001 |
| JP | 2001-319577 | | 11/2001 |
| JP | 2003-086105 | A | 3/2003 |
| JP | 2003-257321 | | 9/2003 |
| JP | 2003-303548 | | 10/2003 |
| JP | 2004-006307 | | 1/2004 |
| JP | 2004-039578 | | 2/2004 |

OTHER PUBLICATIONS

Patent Abstracts of Japan for Publication No. 2001-319577; Date of publication of application Nov. 16, 2001, in the name of Katsuhiro Hirose.

Patent Abstracts of Japan for Publication No. 2004-039578; Date of publication of application Feb. 5, 2004, in the name of Hirokazu Hashikawa et al.

Patent Abstracts of Japan for Publication No. 07-226164; dated Aug. 22, 1995 in the name of Ichiro Koiwa, et al.

Patent Abstracts of Japan for Publication No. 08-022772; dated Jan. 23, 1996 in the name of Kimio Amamiya.

Patent Abstracts of Japan for Publication No. 09-035641; dated Feb. 7, 1997 in the name of Mitsuro Mita, et al.

Patent Abstracts of Japan for Publication No. 09-265913; dated Oct. 7, 1997 in the name of Kimio Amamiya.

Patent Abstracts of Japan for Publication No. 2001-189132; dated Jul. 10, 2001 in the name of Shinichiro Shiromizu.

Patent Abstracts of Japan for Publication No. 2003-257321; dated Sep. 12, 2003 in the name of Hirokazu Hashikawa.

Patent Abstracts of Japan for Publication No. 2003-303548; dated Oct. 24, 2003 in the name of Shigeru Kojima.

Patent Abstracts of Japan for Publication No. 2004-006307; dated Jan. 8, 2004 in the name of Morio Fujitani.

Patents Abstracts of Japan, Publication No. JP 2003-086105, dated Mar. 20, 2003, in the name of Ogawa.

* cited by examiner

LOW ADDRESS DISCHARGE VOLTAGE PLASMA DISPLAY PANEL

CROSS-REFERENCE TO RELATED APPLICATION

This application claims priority to and the benefit of Korean Patent Application 10-2004-0029978 filed in the Korean Intellectual Property Office on Apr. 29, 2004, the entire content of which is incorporated herein by reference

BACKGROUND OF THE INVENTION

1. Field of the Invention

The present invention relates to a plasma display panel (PDP).

2. Description of the Related Art

A PDP is a display device that realizes the display of images through the excitation of phosphors by plasma discharge. That is, vacuum ultraviolet (VUV) rays emitted from plasma obtained via gas discharge excite phosphor layers, which then emit visible red (R), green (G), and blue (B) light to thereby form images. The PDP has many advantages including an ability to be made having large screen sizes of 60 inches and greater, a thin profile of 10 cm or less, a wide viewing angle and good color reproduction due to the self-emissive nature of the PDP (as in the case of cathode-ray tubes), and high productivity and low manufacturing costs as a result of manufacturing processes that are more simple than those involved with liquid crystal displays. As a result, the PDP is experiencing increasingly widespread use in the home and in industry.

In the conventional alternating current (AC) PDP, a rear substrate and a front substrate are provided opposing one another with a predetermined gap therebetween. Formed on a surface of the rear substrate opposing the front substrate are a plurality of address electrodes. The address electrodes are formed in a stripe pattern along a first direction. A first dielectric layer is formed on the rear substrate covering the address electrodes, and a plurality of barrier ribs are formed on the first dielectric layer. The barrier ribs are typically formed in a stripe pattern along the first direction and at areas corresponding to between the address electrodes. R, G, and B phosphor layers are respectively formed between adjacent pairs of the barrier ribs.

Formed on a surface of the front substrate opposing the rear substrate are a plurality of display electrodes, which are realized through bus electrodes and opposing pairs of transparent electrodes. A second dielectric layer and an MgO protection layer are formed in this order on the front substrate covering the display electrodes.

Each area between one of the address electrodes and a pair of the display electrodes, and delimited by the intersection of these elements forms a discharge cell. A few hundred million discharge cells may be formed in a matrix configuration by this arrangement.

A memory characteristic is utilized to simultaneously drive the millions of discharge cells of the AC PDP. A potential difference of at least a predetermined voltage, referred to as a firing voltage Vf, is required to realize discharge between a sustain electrode and a scan electrode forming each pair of the display electrodes. If an address voltage Va is applied between one of the scan electrodes and one of the address electrodes, discharge is initiated such that plasma is created in a corresponding discharge cell. Electrons and ions in the plasma migrate toward the electrode of opposite polarity to thereby realize the flow of current.

With the formation of the first dielectric layer over the address electrodes, and the second dielectric layer over the display electrodes, most of the migrated space charges accumulate on the first and second dielectric layers, which are opposite in polarity. The result is that a net space potential between the scan electrodes and the address electrodes becomes less than the originally applied address voltage Va to weaken discharge and thereby terminate address discharge. A relatively small number of electrons accumulate toward the sustain electrodes, while a relatively large number of ions accumulate toward the scan electrodes. The charge accumulated on the second dielectric layer, which covers the sustain and scan electrodes, is referred to as a wall charge Qw, while the space voltage formed between the sustain and scan electrodes by the wall charge Qw is referred to as a wall voltage Vw.

Subsequently, if a predetermined discharge sustain voltage Vs is applied between the sustain and scan electrodes, and if a sum of the discharge sustain voltage Vs and the wall voltage Vw (Vs+Vw) becomes larger than the firing voltage Vf, discharge is effected in the corresponding discharge cells. VUV rays generated as a result excite the corresponding phosphor layer such that visible light is emitted through the transparent front substrate.

However, when there is no address discharge between the scan electrodes and the address electrodes (i.e., when there is no application of an address voltage Va), no wall charge is present between the sustain and scan electrodes, and, ultimately, no wall voltage between the same. Hence, only the discharge sustain voltage Vs that is applied between the sustain and scan electrodes is formed in the discharge cell, and since this voltage alone is smaller than the firing voltage Vf, no discharge occurs in the gaseous spaces of the sustain and scan electrodes.

In the PDP operating as described above, many steps are involved between power input and obtaining the display of visible light. Further, the efficiency of converting energy in each of these steps is low. The conventional CRT, in fact, has a better overall efficiency (brightness to power consumption ratio) than does the PDP. The low energy efficiency of conventional PDPs is a serious drawback of this display configuration.

SUMMARY OF THE INVENTION

In accordance with the present invention, a plasma display panel is provided in which address discharge is possible at a low voltage to thereby reduce power consumption.

A plasma display panel includes a first substrate and a second substrate provided opposing one another with a predetermined gap therebetween; a plurality of barrier ribs mounted in the predetermined gap to define a plurality of discharge cells; a plurality of phosphor layers respectively formed in the discharge cells; a plurality of display electrodes formed on the first substrate along a first direction; and a plurality of address electrodes formed on the first substrate along a second direction, which intersects the first direction, and separated from the display electrodes.

The plasma display panel further includes a first dielectric layer covering the address electrodes on the first substrate, and a second dielectric layer formed covering the display electrodes on the first dielectric layer.

The plasma display panel further includes discharge grooves, which form address discharge gaps, each of the discharge grooves being provided in the first substrate between one of the address electrodes and a corresponding opposing one of the address electrodes. The discharge grooves may be opened toward the second substrate, and are one of angled and rounded. Further, the discharge grooves may be respectively positioned corresponding to center areas of the discharge cells, or respectively positioned to one side from center areas of the discharge cells.

The address electrodes are aligned with the barrier ribs extending along a direction substantially perpendicular to the display electrodes.

The address electrodes include branches that extend toward inner areas of the discharge cells. In one embodiment the branches are formed to a length at least one-half of a distance between adjacent ones of the barrier ribs. The address electrodes include protrusions extended toward the display electrodes.

In another aspect of the present invention, the display electrodes include sustain electrodes and scan electrodes provided opposing one another for each of the discharge cells; and the sustain electrodes and the scan electrodes respectively include bus electrodes extended substantially aligned with the other bus electrodes, and a plurality of protruding electrodes formed protruding from each of the bus electrodes in a direction toward the discharge cells.

The plasma display panel further includes discharge grooves and address discharge gaps. Each of the discharge grooves are provided in the first substrate between one of the address electrodes and a corresponding opposing one of the scan electrodes. The discharge grooves are respectively positioned to one side toward the scan electrodes from center areas of the discharge cells. The address discharge gaps are formed between the scan electrodes and the address electrodes to effect address discharge.

The protruding electrodes of the sustain electrodes and the protruding electrodes of the scan electrodes are asymmetrical with respect to one another in each of the discharge cells. The protruding electrodes of the sustain electrodes and the protruding electrodes of the scan electrodes are asymmetrical with respect to at least one of a reference line along which the address electrodes are extended, and a reference line along which the display electrodes are extended.

The protruding electrodes of the scan electrodes may have a width less than a width of the protruding electrodes of the sustain electrodes. The protruding electrodes of the scan electrodes are positioned closer toward one of two of the address electrodes flanking the protruding electrodes.

In another example, the protruding electrodes of the scan electrodes have a width and a length respectively less than and greater than a width and a length of the protruding electrodes of the sustain electrodes. The protruding electrodes of the scan electrodes are positioned closer toward one of two of the address electrodes flanking the protruding electrodes.

The plasma display panel further includes protruding barrier ribs extending from the barrier ribs toward the protruding electrodes of the scan electrodes. The protruding electrodes of the scan electrodes are directed closer toward the barrier ribs opposite those from which the protruding barrier ribs are formed.

DETAILED DESCRIPTION

Figure 1:
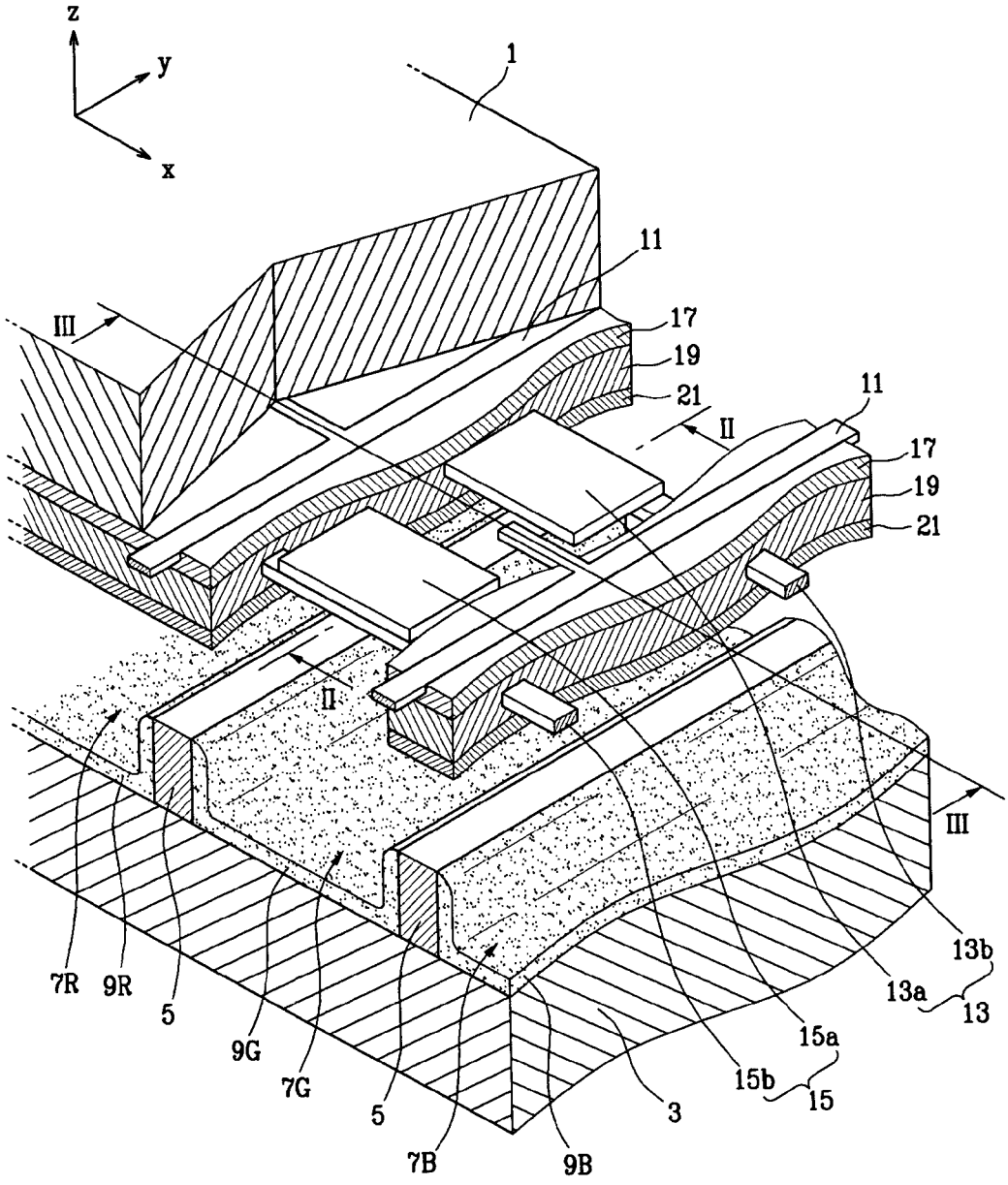
FIG. 1 is a partial exploded perspective sectional view of a plasma display panel according to a first exemplary embodiment of the present invention.

Referring to FIG. 1, the PDP according to the first exemplary embodiment of the present invention includes a first substrate 1 and a second substrate 3 sealed opposing one another with a predetermined gap therebetween. An inert gas is filled in the gap. A plurality of barrier ribs 5 are mounted between the first and second substrates 1, 3. The barrier ribs 5 define a plurality of discharge cells 7R, 7G, 7B, and phosphor layers 9R, 9G, 9B are formed by depositing R, G, and B phosphor material between and on inner walls of the barrier ribs 5.

A plurality of address electrodes 11 are formed on the first substrate 1 along a first direction (direction y in the drawing), and a plurality of display electrodes 13, 15 are formed on the first substrate 1 along a second direction (direction x in the drawing), which is substantially perpendicular to the first direction.

The barrier ribs 5 provided between the first and second substrates 1, 3 are formed substantially parallel to each other, and adjacent pairs of the barrier ribs 5 define the discharge cells 7R, 7G, 7B required for plasma discharge. Such a stripe pattern of the barrier ribs 5 is used merely as an example, and the present invention is not limited in this respect. For example, a closed matrix configuration (e.g., a lattice) may be employed, in which barrier ribs are extended along both directions x and y intersecting one another.

The address electrodes 11 are covered by a first dielectric layer 17 to enable the formation of wall charges in the discharge cells 7R, 7G, 7B to effect address discharge. In one embodiment the first dielectric layer 17 is formed of a transparent dielectric to ensure transmissivity of visible light.

The display electrodes 13, 15 are respectively sustain electrodes 13 and scan electrodes 15, which are provided in opposing pairs. The sustain and scan electrodes 13, 15 cooperate with the address electrodes 11 to effect address discharge, then effect sustain discharge in the discharge cells 7R, 7G, 7B. The sustain and scan electrodes 13, 15 include transparent electrodes 13*a*, 15*a* and bus electrodes 13*b*, 15*b*.

The transparent electrodes 13*a*, 15*a* function to effect plasma discharge in the discharge cells 7R, 7G, 7B. To ensure good brightness, in one embodiment the transparent electrodes 13*a*, 15*a* are made of a transparent material such as ITO (indium tin oxide). The bus electrodes 13*b*, 15*b* compensate for the high resistance of the transparent electrodes 13*a*, 15*a* to thereby maintain high conductivity levels. In one embodiment the bus electrodes 13*b*, 15*b* are made of a metal material.

The display electrodes 13, 15, that is, the sustain and scan electrodes 13, 15, are mounted in opposing pairs as described above. The bus electrodes 13*b*, 15*b* are formed in pairs and each in substantially a straight-line configuration along direction x, and the transparent electrodes 13*a*, 15*a* are extended toward inner areas of the discharge cells 7R, 7G, 7B respectively from the bus electrodes 13*b*, 15*b*. As a result, a pair of one of the transparent electrodes 13*a* and one of the transparent electrodes 15*a* is provided in areas corresponding to each of the discharge cells 7R, 7G, 7B. The display electrodes 13, 15 are covered by a second dielectric layer 19 and an MgO protection layer 21. In one embodiment the first and second dielectric layers 17, 19 are made of the same type of transparent dielectric so that transmission of visible light occurs without distortion thereof.

Figure 2:
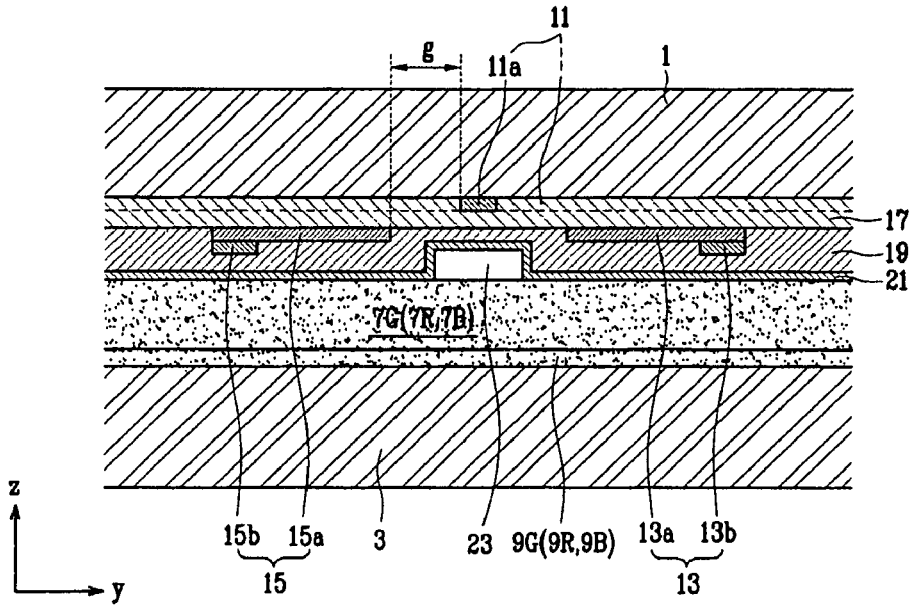
FIG. 2 is a partial sectional view taken along line II-II of FIG. 1.
Figure 3:
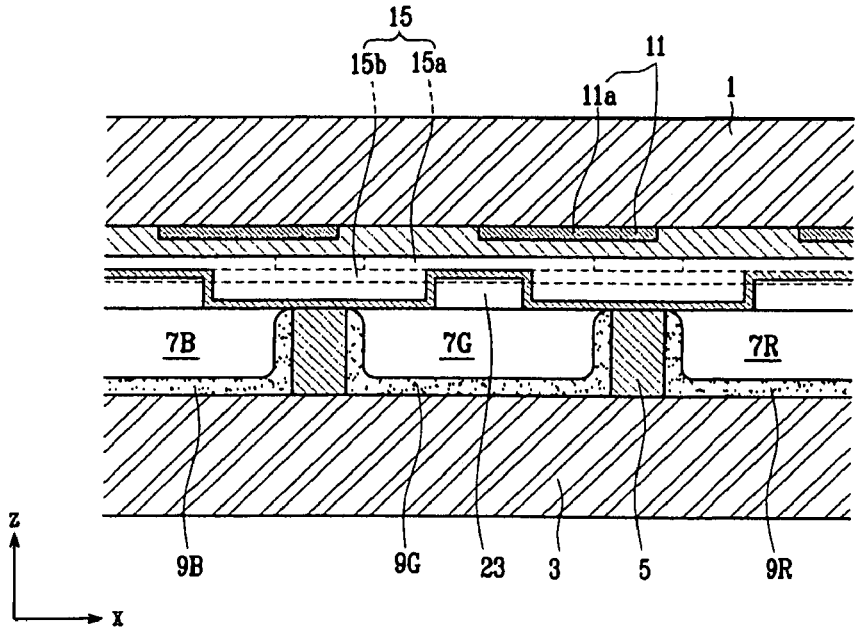
FIG. 3 is a partial sectional view taken along line III-III of FIG. 1.

FIG. 2 is a partial sectional view taken along line II-II of FIG. 1, and FIG. 3 is a partial sectional view taken along line III-III of FIG. 1. The stacking structure of the address electrodes 11, the sustain electrodes 13, and the scan electrodes 15 will now be described with additional reference to these figures.

The address electrodes 11 are formed along direction y on an inner surface of the first substrate 1, and are covered with the first dielectric layer 17. The transparent electrodes 13*a*, 15*a*, which are mounted on the first dielectric layer 17 in opposing pairs, are arranged extended along direction y. The bus electrodes 13*b*, 15*b* are mounted on the transparent electrodes 13*a*, 15*a* and extend along direction x. The transparent electrodes 13*a*, 15*a* and the bus electrodes 13*b*, 15*b* are covered with the second dielectric layer 19, which, in turn, is covered by the MgO protection layer 21.

Address discharge occurs between the address electrodes 11 and the transparent electrodes 15*a* of the scan electrodes 15. As a result, discharge grooves 23 and discharge gaps g are formed on the first substrate 1. The discharge grooves 23 are used for address discharge occurring between the address electrodes 11 and the scan electrodes 15, and, in one embodiment are formed adjacent to the scan electrodes 15. With the address electrodes 11 and the scan electrodes 15 mounted in proximity to each other, the address voltage needed for address discharge may be reduced, thereby minimizing the power consumed by the PDP.

The discharge grooves 23 may be formed to a variety of different configurations. As an example, the discharge grooves 23 may be opened toward the second substrate 3 from the first substrate 1, that is, opened toward the discharge cells 7R, 7G, 7B, with an angled or rounded plan configuration. An angled shape increases the address discharge space with respect to the opening in the discharge grooves 23, while a rounded shape allows for easier formation of the MgO protection layer 21 in the discharge grooves 23 than when using the angled shape.

Further, the discharge grooves 23 may be formed at various positions adjacent to the scan electrodes 15 depending on the mounting configuration of the transparent electrodes 13*a*, 15*a* and the address electrodes 11. Examples include discharge grooves 23 being formed in the first substrate 1 at areas respectively corresponding to centers of the discharge cells 7R, 7G, 7B, and at off-center areas thereof.

Figure 4:
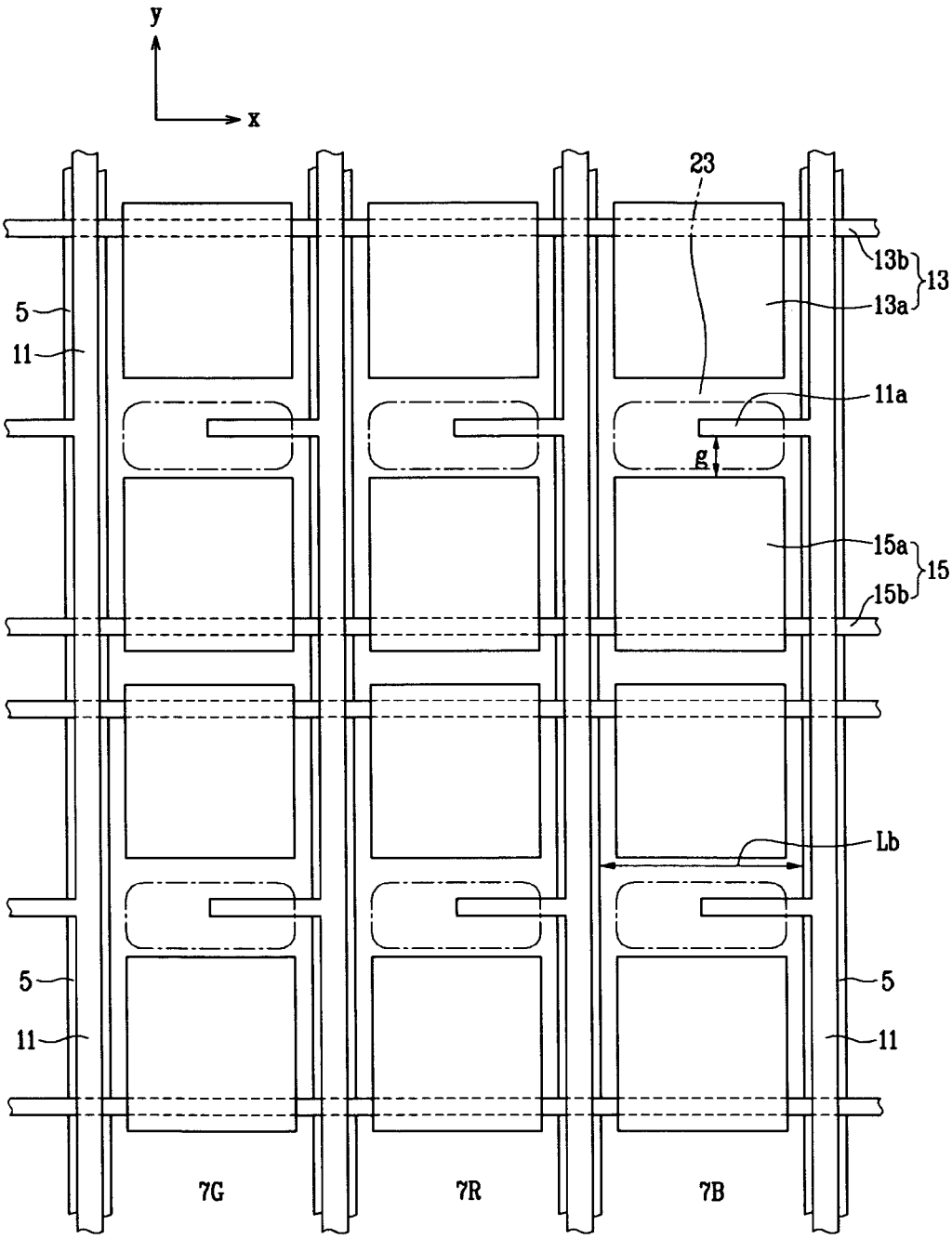
FIG. 4 is a partial plan view of the plasma display panel of FIG. 1.

FIG. 4 is a partial plan view of the PDP of FIG. 1. The address electrodes 11 are formed respectively corresponding to the barrier ribs 5, which are extended along direction y, or substantially perpendicular to the direction of the extension portion of the sustain electrodes and the scan electrodes 13, 15. Since the address electrodes 11 are formed at non-discharge areas of the barrier ribs 5, a reduction in brightness does not occur as a result of the presence of the address electrodes 11.

In addition to being formed in a striped pattern at areas corresponding to the barrier ribs 5 as described above, the address electrodes 11 may also include branches 11*a* that are extended therefrom. In one embodiment the branches 11*a* are formed toward inner areas of the discharge cells 7R, 7G, 7B along a direction substantially perpendicular to the main portions of the address electrodes 11.

The branches 11*a* function to reduce address discharge voltage, and in one embodiment are extended toward the scan electrodes 15, which, among the display electrodes 13, 15, function during address discharge. In FIG. 4, the branches 11*a* are shown extended between the opposing sustain and scan electrodes 13, 15. The branches 11*a* may be extended adjacent to the scan electrodes 15. In more detail, the branches 11*a* may be extended more adjacent to the transparent electrodes 15*a* of the scan electrodes 15 than to the transparent electrodes 13*a* of the sustain electrodes 13.

In one embodiment the branches 11*a* are formed extending respectively in the discharge cells 7R, 7G, 7B to one-half or more of a length (Lb) between two adjacent ones of the barrier ribs 5 to increase the opposing area with the transparent electrodes 15*a* in the discharge cells 7R, 7G, 7B while not effecting mis-discharge in adjacent ones of the discharge cells 7R, 7G, 7B. With the increase in the opposing areas between branches 11*a* and the transparent electrodes 15*a*, effective address discharge occurs between the address electrodes 11 and the scan electrodes 15.

Since the branches 11*a* may be formed above center areas of the discharge cells 7R, 7G, 7B, in one embodiment the discharge grooves 23 may be formed in upper center areas of the discharge cells 7R, 7G, 7B.

In one embodiment the discharge grooves 23 are included in the configuration of the PDP and the address electrodes 11 do not include the branches 11*a*. However, when the branches 11*a* are included in the structure extended from the address electrodes 11 as shown in the drawings, it is possible to omit the discharge grooves 23 from the configuration. When the branches 11*a* are not formed from the address electrodes 11, the address electrodes 11 may be provided closer to the discharge cells 7R, 7G, 7B than when the branches 11*a* are included in the structure.

Figure 5:
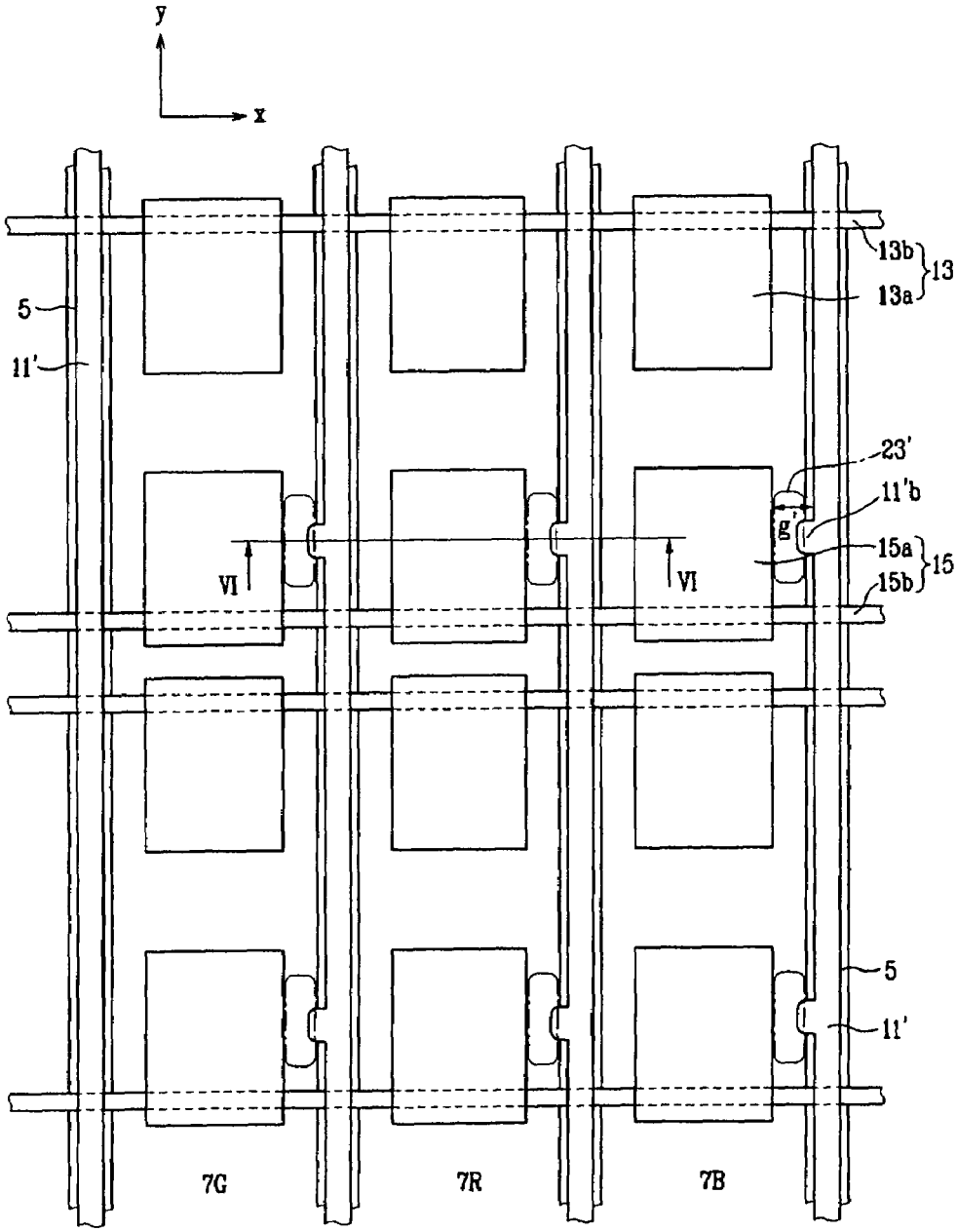
FIG. 5 is a partial plan view of a plasma display panel according to a second exemplary embodiment of the present invention.
Figure 6:
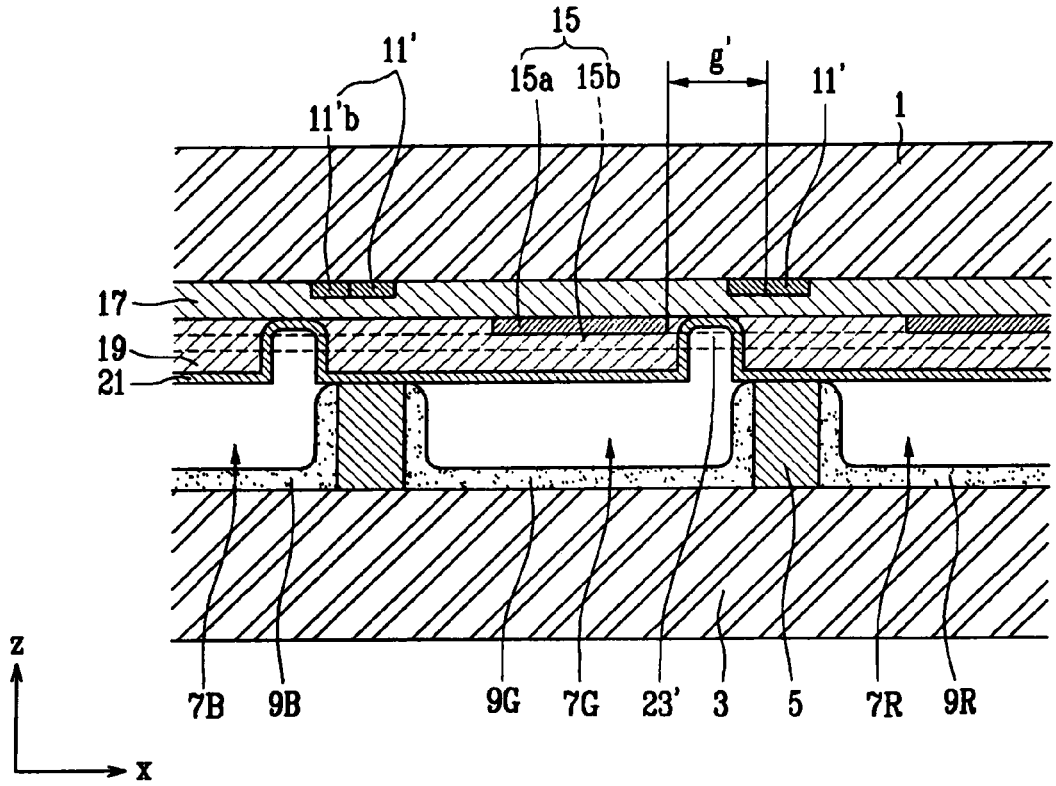
FIG. 6 is a partial sectional view taken along line VI-VI of FIG. 5.

FIG. 5 is a partial plan view of a PDP according to a second exemplary embodiment of the present invention, and FIG. 6 is a partial sectional view taken along line VI-VI of FIG. 5. The overall structure and the resultant advantages of the second exemplary embodiment are similar to those of the first exemplary embodiment. Hence, only aspects that are different from the first exemplary embodiment will be described in the following.

In the second exemplary embodiment, the address electrodes 11' include protrusions 11'*b*, and the PDP includes the display electrodes, that is, the sustain and scan electrodes 13, 15, the transparent electrodes 13*a*, 15*a* thereof, and the discharge grooves 23' in a corresponding configuration.

In more detail, the protrusions 11'*b* are formed extending from the address electrodes 11' toward the scan electrodes 15 to thereby reduce the address discharge gaps g' between the scan electrodes 15 and the address electrodes 11', which cooperate to effect address discharge. Further, the discharge grooves 23' are positioned to one side from the upper center areas of the discharge cells 7R, 7G, 7B. The discharge grooves 23' are formed to a rounded shape between the scan electrodes 15, the address electrodes 11', and the protrusions 11'*b* of the address electrodes 11'.

FIGS. 7-12 show partial plan views of PDPs respectively according to third through eighth exemplary embodiments of the present invention. In contrast to the first and second exemplary embodiments, the sustain and scan electrodes of these exemplary embodiments are asymmetrical with respect to each other. That is, in the first and second exemplary embodiments, the transparent electrodes 13*a* of the sustain electrodes 13 and the transparent electrodes 15*a* of the scan electrodes 15 are symmetrical along both directions x and y. However, in the third through eighth exemplary embodiments, the transparent electrodes of the sustain electrodes and the transparent electrodes of the scan electrodes are asymmetrical about reference lines drawn along direction x and/or direction y.

The asymmetrical structure of the transparent electrodes prevents mis-discharge between adjacent ones of the discharge cells 7R, 7G, 7B. To realize this function, the transparent electrodes of the scan electrodes are positioned adjacent to the address electrodes together with which address discharge is effected, but distanced from the corresponding opposite address electrodes.

In spite of these differences in structure, the PDPs of the third through eighth exemplary embodiments, as with the PDPs of the first and second exemplary embodiments, reduce address voltage to thereby minimize power consumption of the PDP. The focus in the following description will be on the differences in structures as compared with the first and second exemplary embodiments.

In the following description of the third through eighth embodiments of FIGS. 7-12, "widths" and "lengths" will refer to dimensions respectively along directions x and y in the drawings. Further, the terms "large," "small," and "identical" will be relative in meaning, that is, relative to the opposing ones of the transparent electrodes 13*a* or 15*a* of the sustain and scan electrodes 13, 15.

Figure 7:
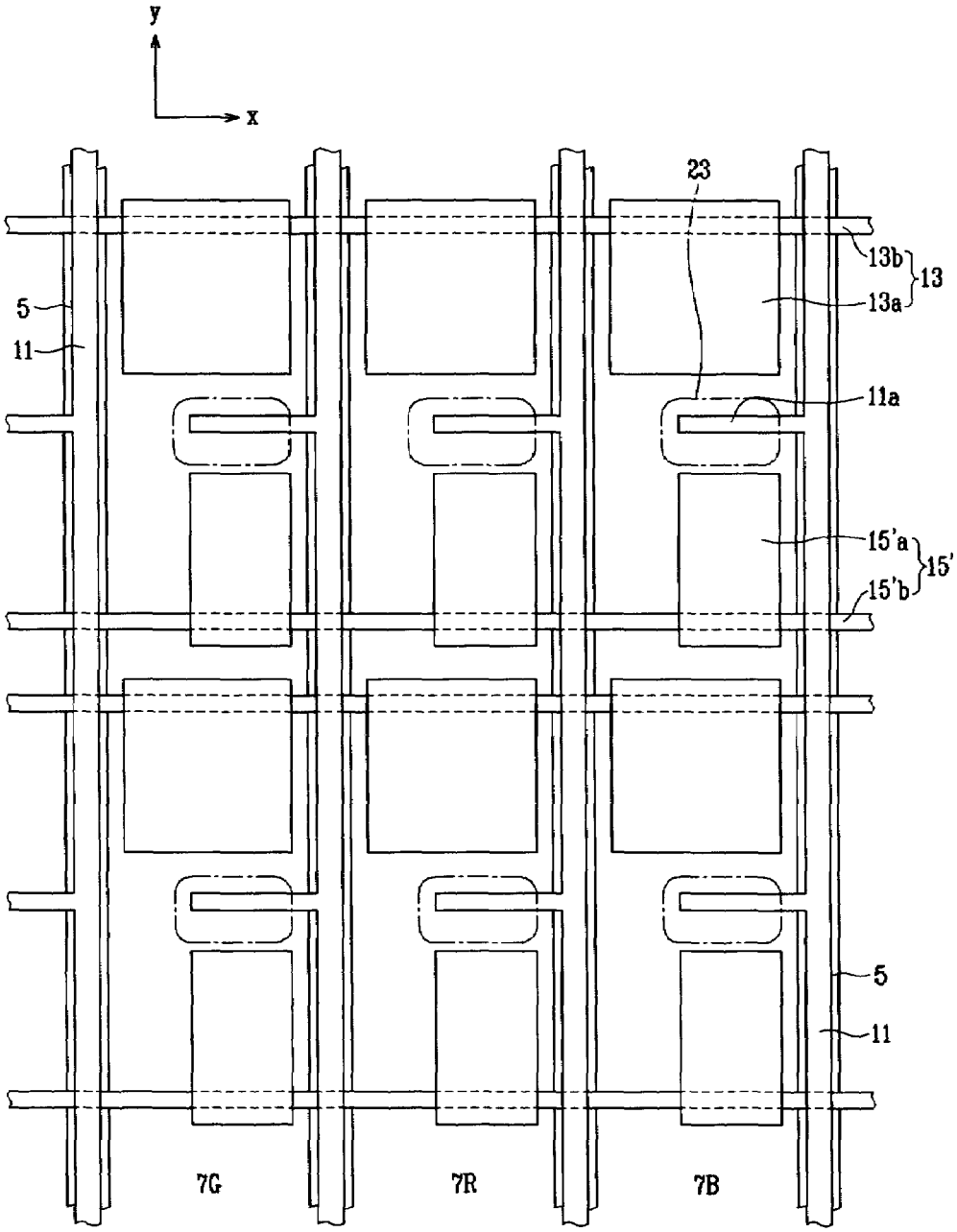
FIG. 7 is a partial plan view of a plasma display panel according to a third exemplary embodiment of the present invention.

FIG. 7 is a partial plan view of a PDP according to a third exemplary embodiment of the present invention. The transparent electrodes 13*a* of the sustain electrodes 13 are formed have a large width and large length. In contrast, the transparent electrodes 15'*a* of the scan electrodes 15' are formed having a small width and large length. Hence, the transparent electrodes 13*a*, 15*a* are asymmetrical with respect to each other.

Further, the transparent electrodes 15'*a* are positioned close to corresponding ones of the address electrodes 11 (i.e., the address electrodes 11 together with which address discharge is effected). As a result, the transparent electrodes 15'*a* are distanced from the address electrodes 11 that are not cooperated with to effect address discharge, thereby preventing mis-discharge.

The branches 11*a* of the address electrodes 11 are extended between the transparent electrodes 13*a* of the sustain electrodes 13 and the transparent electrodes 15'*a* of the scan electrodes 15'. The branches 11*a* function to reduce address discharge voltage as described with reference to the previous embodiments.

Figure 8:
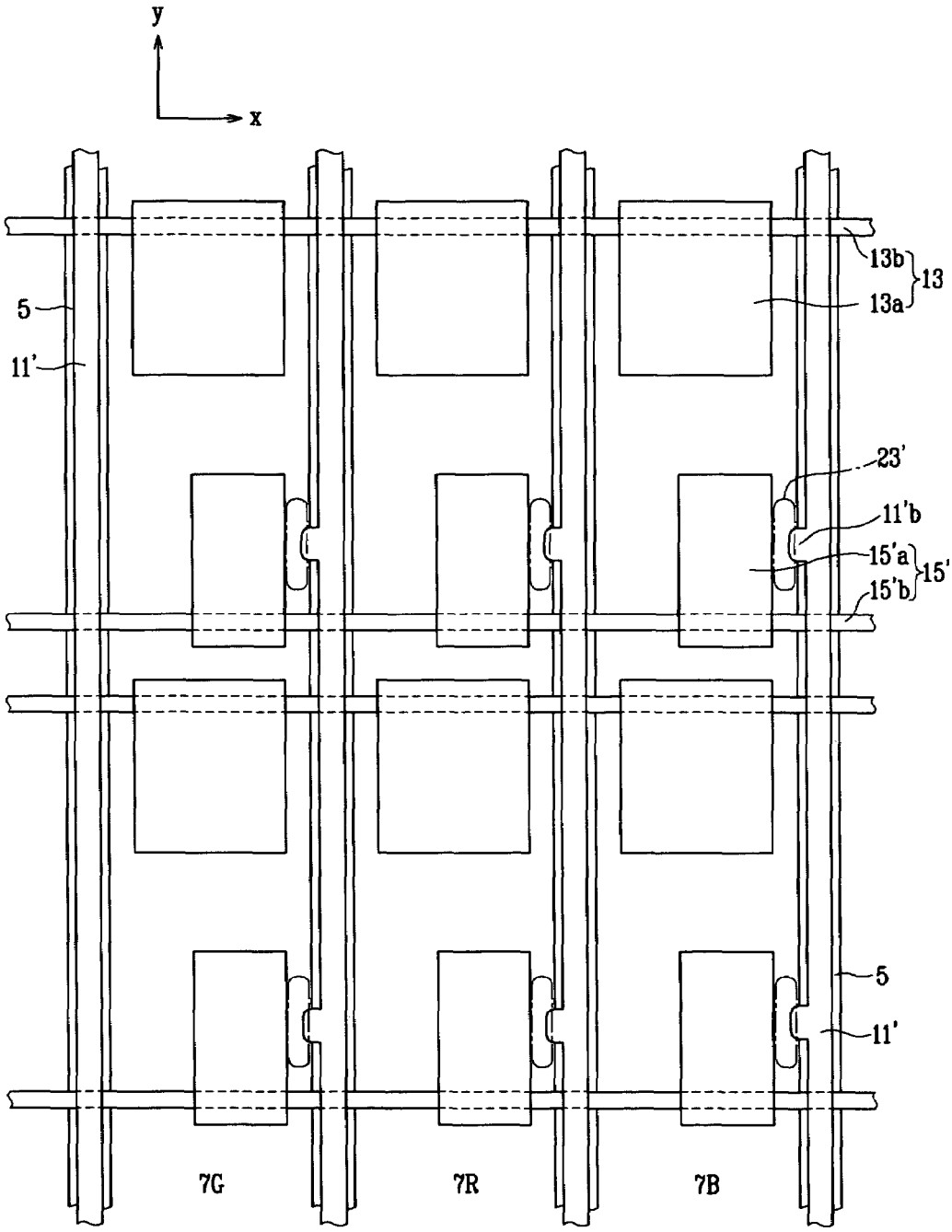
FIG. 8 is a partial plan view of a plasma display panel according to a fourth exemplary embodiment of the present invention.

FIG. 8 is a partial plan view of a PDP according to a fourth exemplary embodiment of the present invention. The address electrodes 11' of the fourth exemplary embodiment include protrusions 11'*b*, which are extended toward the transparent electrodes 15'*a* of the scan electrodes 15' from the address electrodes 11'. Other aspects of the fourth exemplary embodiment are identical to those of the third exemplary embodiment.

Figure 9:
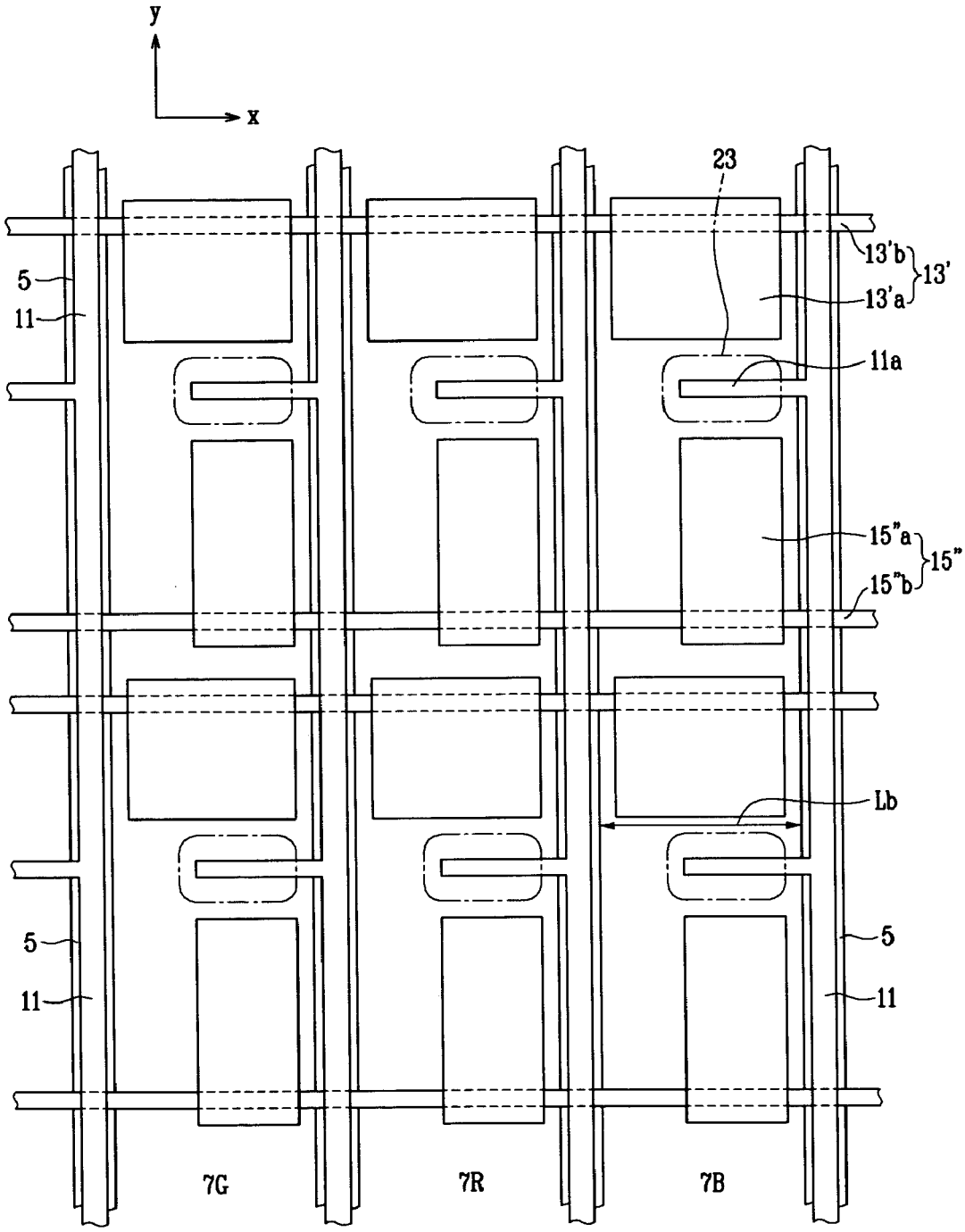
FIG. 9 is a partial plan view of a plasma display panel according to a fifth exemplary embodiment of the present invention.

FIG. 9 is a partial plan view of a PDP according to a fifth exemplary embodiment of the present invention. The transparent electrodes 13'*a* of the sustain electrodes 13' have a large width and small length. In contrast, the transparent electrodes 15"*a* of the scan electrodes 15" have a small width and a large length, thereby resulting in an asymmetrical configuration between these elements. That is, the transparent electrodes 15"*a* of the scan electrodes 15" have a smaller width but greater length than the transparent electrodes 13'*a* of the sustain electrodes 13'.

Further, the transparent electrodes 15"*a* of the scan electrodes 15" are positioned close to corresponding ones of the address electrodes 11 (i.e., the address electrodes 11 together with which address discharge is effected), while being distanced from the address electrodes 11 that are not cooperated with to effect address discharge, thereby preventing mis-discharge.

The branches 11*a* of the address electrodes 11 are extended between the transparent electrodes 13'*a* of the sustain electrodes 13' and the transparent electrodes 15"*a* of the scan electrodes 15". The branches 11*a* function to reduce address discharge voltage as described with reference to the previous embodiments.

Figure 10:
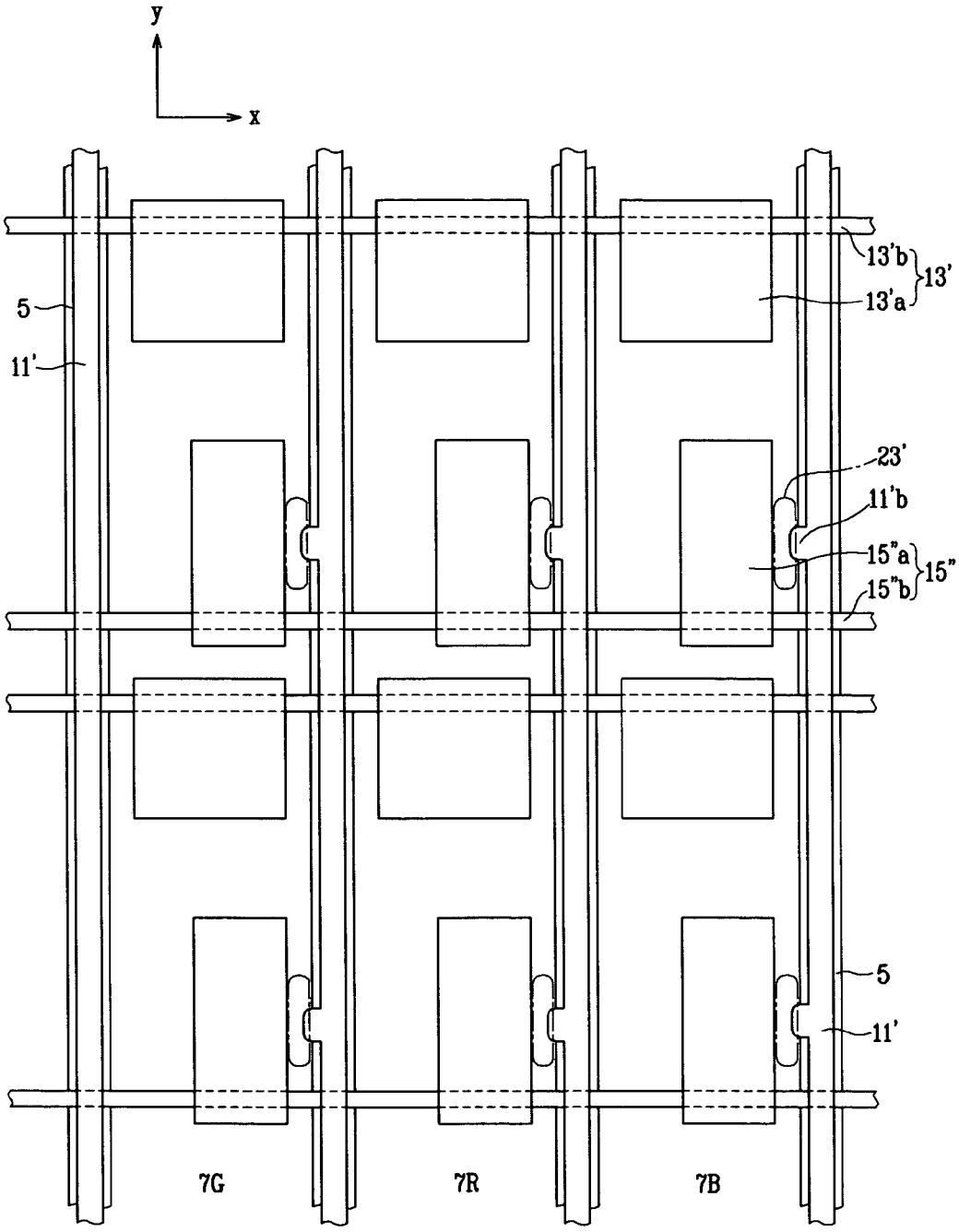
FIG. 10 is a partial plan view of a plasma display panel according to a sixth exemplary embodiment of the present invention.

FIG. 10 is a partial plan view of a PDP according to a sixth exemplary embodiment of the present invention. The address electrodes 11' of the sixth exemplary embodiment include protrusions 11'*b*, which are extended toward the transparent electrodes 15"*a* of the scan electrodes 15" from the address electrodes 11'. Other aspects of the sixth exemplary embodiment are identical to those of the fifth exemplary embodiment.

Figure 11:
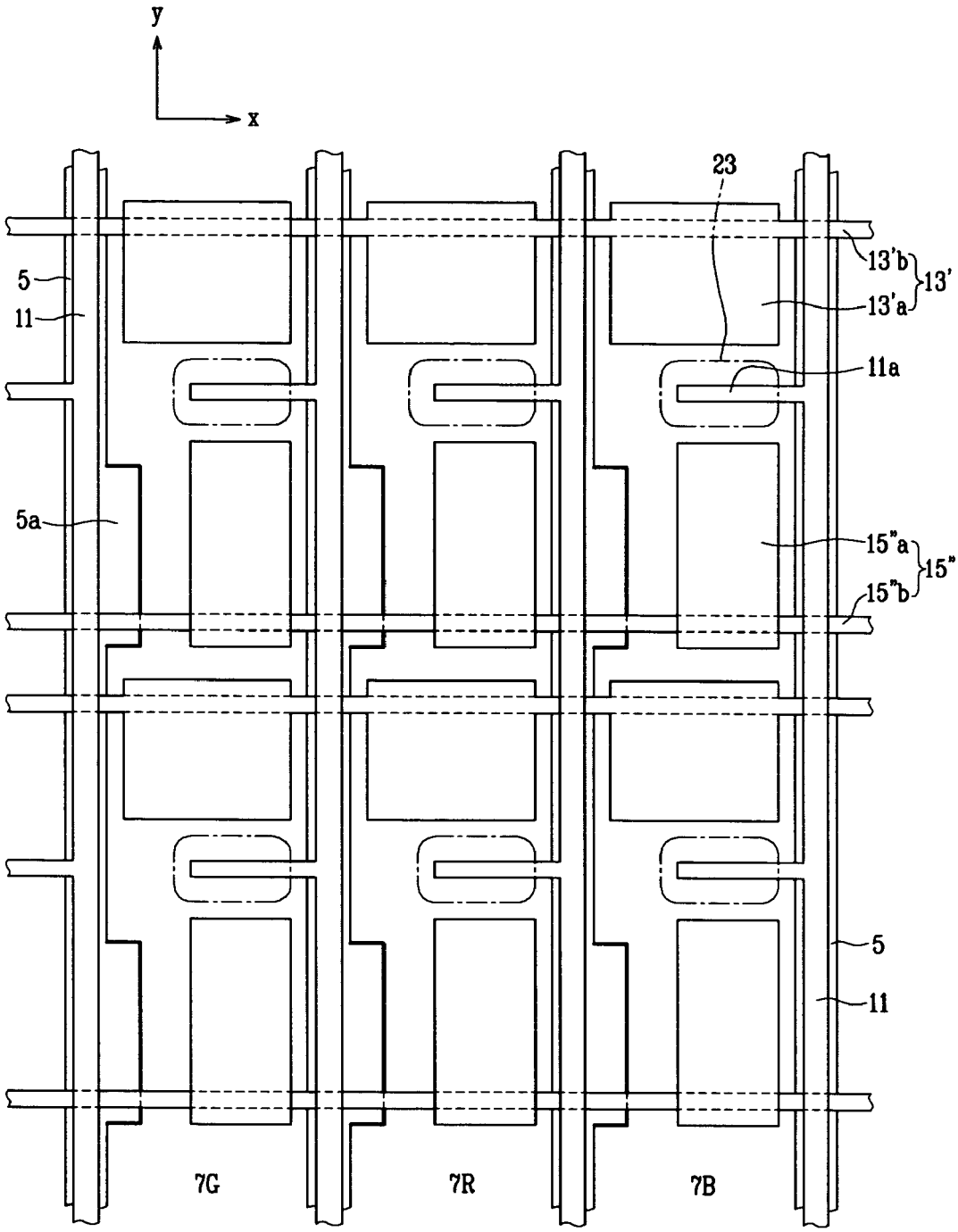
FIG. 11 is a partial plan view of a plasma display panel according to a seventh exemplary embodiment of the present invention.

FIG. 11 is a partial plan view of a PDP according to a seventh exemplary embodiment of the present invention. The transparent electrodes 13'*a* of the sustain electrodes 13' have a large width and small length. In contrast, the transparent electrodes 15"*a* of the scan electrodes 15" have a small width and a large length, thereby resulting in an asymmetrical configuration between these elements.

Further, the transparent electrodes 15"*a* of the scan electrodes 15" are positioned closely to corresponding ones of the address electrodes 11 (i.e., the address electrodes 11 together with which address discharge is effected), while being distanced from the address electrodes 11 that are not cooperated with to effect address discharge, thereby preventing mis-discharge.

Furthermore, in the seventh exemplary embodiment, protrusion barrier ribs 5*a* are formed extended from the barrier ribs 5. The protrusion barrier ribs 5*a* function to further isolate the transparent electrodes 15"*a* of the scan electrodes 15" from the address electrodes 11 that are not cooperated with to effect address discharge. This provides a mechanism to further prevent mis-discharge.

The branches 11*a* of the address electrodes 11 are extended between the transparent electrodes 13'*a* of the sustain electrodes 13' and the transparent electrodes 15"*a* of the scan electrodes 15". The branches 11*a* function to reduce address discharge voltage as described with reference to the previous embodiments.

Figure 12:
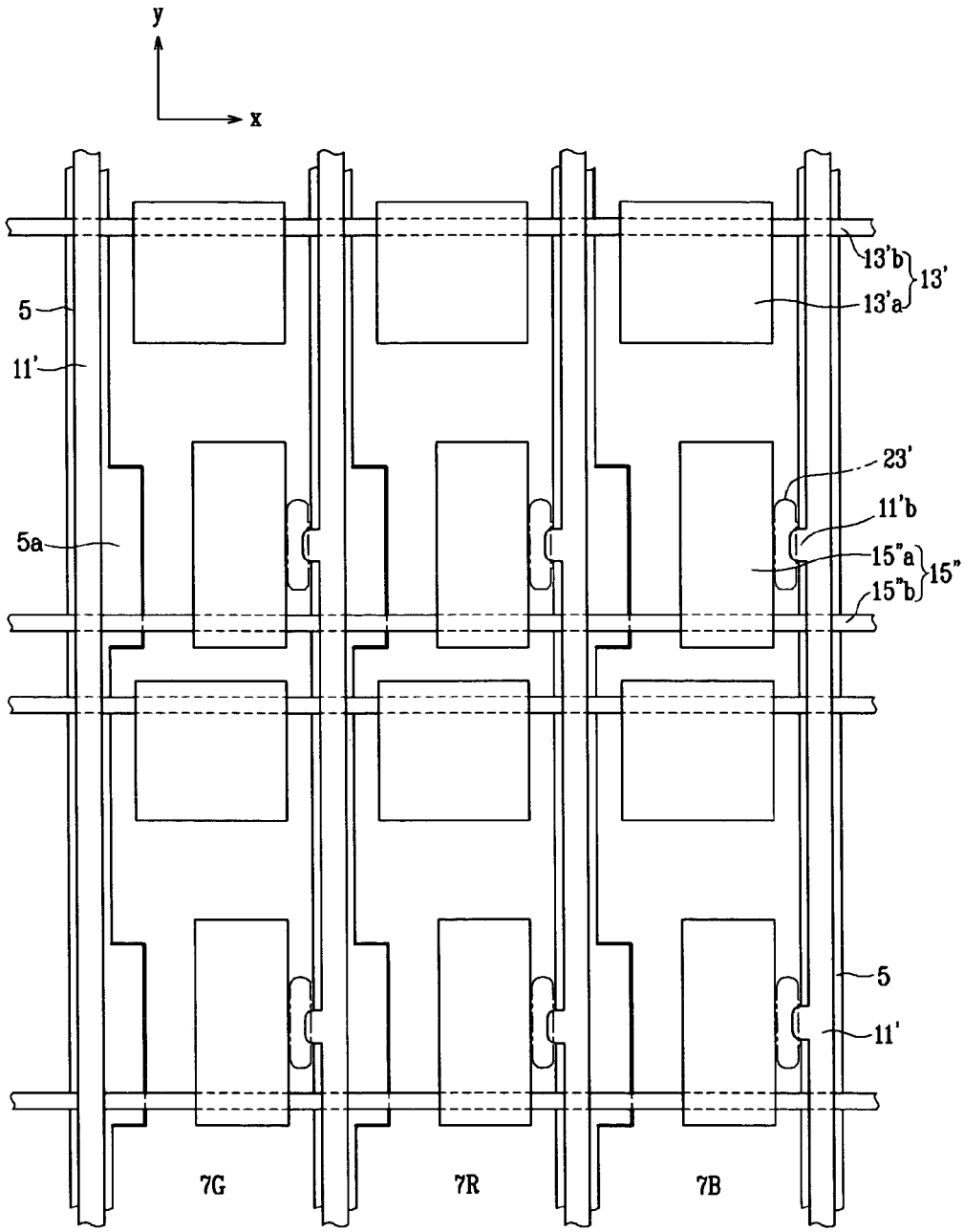
FIG. 12 is a partial plan view of a plasma display panel according to an eighth exemplary embodiment of the present invention.

FIG. 12 is a partial plan view of a PDP according to an eighth exemplary embodiment of the present invention. The address electrodes 11' of the eighth exemplary embodiment include protrusions 11'*b*, which are extended toward the transparent electrodes 15"*a* of the scan electrodes 15" from the address electrodes 11' opposite the transparent electrodes 15"*a*. Other aspects of the eighth exemplary embodiment are identical to those of the seventh exemplary embodiment.

As a result, the discharge distance of the address electrodes 11' with the scan electrodes 15" is reduced. With the formation of the protrusions 11'*b*, this discharge distance is further reduced, thereby minimizing the address discharge voltage.

Further, the transparent electrodes 15"*a* of the scan electrodes 15" are asymmetrically formed by being formed to one side of the discharge cells 7R, 7G, 7B, or by further including protrusion barrier ribs 5*a* extending from the barrier ribs 5 opposite to the address electrodes 11' that cooperate with the scan electrodes 15" for address discharge. As a result, address discharge with the address electrodes 11' adjacent to the transparent electrodes 15"*a* is enhanced, while mis-discharge with the opposite address electrodes 11' is effectively prevented.

In the PDP of the present invention described above, by forming the address electrodes and the display electrodes (i.e., sustain and scan electrodes) on the first substrate, the discharge distance between the address electrodes and the scan electrodes is reduced to thereby allow address discharge to occur at a low voltage. Hence, the power consumption of the PDP is minimized.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate opposing one another with a gap therebetween;

barrier ribs in the gap and defining a plurality of discharge cells;

a phosphor layer in each of the discharge cells;

address electrodes on the first substrate and extending in a first direction;

a first dielectric layer covering and touching the address electrodes;

display electrodes on the first dielectric layer and extending in a second direction intersecting the first direction and separated from the address electrodes;

a second dielectric layer covering and touching the display electrodes on the first dielectric layer; and discharge grooves, each of the discharge grooves being in the second dielectric layer in a portion of an area opposite the phosphor layer of a corresponding one of the plurality of discharge cells, and is offset in the first and second directions from the display electrodes corresponding to the corresponding one of the plurality of discharge cells.

2. The plasma display panel of claim 1, further comprising address discharge gaps between the display electrodes and the address electrodes, each of the address discharge gaps overlapping with a corresponding one of the discharge grooves.

3. The plasma display panel of claim 1, wherein the discharge grooves are opened toward the second substrate, and have an angled or rounded shape.

4. The plasma display panel of claim 1, wherein the discharge grooves respectively correspond to center areas of the discharge cells.

5. The plasma display panel of claim 1, wherein each of the discharge grooves is offset from a center area of the corresponding one of the plurality of discharge cells.

6. The plasma display panel of claim 1, wherein the address electrodes are aligned with the barrier ribs extending along a direction substantially perpendicular to the display electrodes.

7. The plasma display panel of claim 6, wherein the address electrodes include branches extending toward inner areas of the discharge cells.

8. The plasma display panel of claim 7, wherein the branches have a length that is at least one-half of a distance between adjacent ones of the barrier ribs.

9. The plasma display panel of claim 6, wherein the address electrodes include protrusions extended toward the display electrodes.

10. A plasma display panel, comprising:

a first substrate and a second substrate opposing one another with a gap therebetween;

barrier ribs in the gap and defining a plurality of discharge cells;

a phosphor layer in each of the discharge cells;

address electrodes on the first substrate and extending in a first direction;

a first dielectric layer covering and touching the address electrodes;

display electrodes on the first dielectric layer and extending in a second direction intersecting the first direction and separated from the address electrodes, the display electrodes comprising sustain electrodes and scan electrodes, each of the discharge cells having a corresponding one of the sustain electrodes and a corresponding one of the scan electrodes opposing one another, the sustain electrodes and the scan electrodes respectively including bus electrodes extended substantially aligned with other bus electrodes and protruding electrodes protruding from each of the bus electrodes in a direction toward a center of respective discharge cells from among the plurality of discharge cells;

a second dielectric layer covering and touching the display electrodes on the first dielectric layer; and discharge grooves, each of the discharge grooves being in the second dielectric layer in a portion of an area opposite the phosphor layer of a corresponding one of the plurality of discharge cells, and is offset in the first and second directions from the scan electrodes corresponding to the corresponding one of the plurality of discharge cells.

11. The plasma display panel of claim 10, further comprising address discharge gaps between the scan electrodes and the address electrodes.

12. The plasma display panel of claim 10, wherein each of the discharge grooves is offset toward the scan electrodes corresponding to the corresponding one of the plurality of discharge cells from a center area of the corresponding one of the plurality of discharge cells.

13. The plasma display panel of claim 10, wherein the address electrodes are aligned with the barrier ribs extending along a direction substantially perpendicular to the sustain electrodes and the scan electrodes.

14. The plasma display panel of claim 13, wherein the address electrodes include branches extending toward the discharge grooves, the branches extended more adjacent to the protruding electrodes of the scan electrodes than to the protruding electrodes of the sustain electrodes.

15. The plasma display panel of claim 14, wherein the branches have a length that is at least one-half of a distance between adjacent ones of the barrier ribs.

16. The plasma display panel of claim 13, wherein the address electrodes include protrusions extended toward the protruding electrodes of the scan electrodes.

17. The plasma display panel of claim 10, wherein the protruding electrodes of the sustain electrodes and the protruding electrodes of the scan electrodes are asymmetrical with respect to one another in each of the discharge cells.

18. The plasma display panel of claim 17, wherein the protruding electrodes of the sustain electrodes and the protruding electrodes of the scan electrodes are asymmetrical with respect to at least one of a reference line along which the address electrodes are extended, and a reference line along which the display electrodes are extended.

19. The plasma display panel of claim 17, wherein the protruding electrodes of the scan electrodes have a width less than a width of the protruding electrodes of the sustain electrodes.

20. The plasma display panel of claim 19, wherein the protruding electrodes of the scan electrodes are closer toward one of two of the address electrodes flanking the protruding electrodes.

21. The plasma display panel of claim 19, wherein the address electrodes include branches extended between the protruding electrodes of the sustain electrodes and the protruding electrodes of the scan electrodes.

22. The plasma display panel of claim 19, wherein the address electrodes include protrusions extended toward the protruding electrodes of the scan electrodes.

23. The plasma display panel of claim 10, wherein the protruding electrodes of the scan electrodes have a width and a length respectively less than and greater than a width and a length of the protruding electrodes of the sustain electrodes.

24. The plasma display panel of claim 23, wherein the protruding electrodes of the scan electrodes are more closer toward one of two of the address electrodes flanking the protruding electrodes.

25. The plasma display panel of claim 23, wherein the address electrodes include branches extended between the protruding electrodes of the sustain electrodes and the protruding electrodes of the scan electrodes.

26. The plasma display panel of claim 23, wherein the address electrodes include protrusions extended toward the protruding electrodes of the scan electrodes.

27. The plasma display panel of claim 23, further comprising protruding barrier ribs extending from the barrier ribs toward the protruding electrodes of the scan electrodes.

28. A plasma display panel, comprising:

a first substrate and a second substrate opposing one another with a gap therebetween;

barrier ribs in the gap to define a plurality of discharge cells;

a phosphor layer in each of the discharge cells;

a plurality of address electrodes on the first substrate;

a plurality of display electrodes on the first substrate extending in a direction intersecting the address electrodes and separated from the address electrodes, the display electrodes including sustain electrodes and scan electrodes opposing one another for each of the discharge cells, the sustain electrodes and the scan electrodes respectively including bus electrodes extended substantially aligned with the other bus electrodes and protruding electrodes formed protruding from each of the bus electrodes in a direction toward the discharge cells; and protruding barrier ribs extending from the barrier ribs toward the protruding electrodes of the scan electrodes, wherein the protruding electrodes of the scan electrodes have a width and a length respectively less than and greater than a width and a length of the protruding electrodes of the sustain electrodes, and wherein the protruding electrodes of the scan electrodes are closer toward the barrier ribs opposite barrier ribs from which the protruding barrier ribs are extended.

* * * * *